US009387695B2

(12) United States Patent
Nemoto

(10) Patent No.: US 9,387,695 B2
(45) Date of Patent: Jul. 12, 2016

(54) PLASMA TREATMENT APPARATUS, PRINTING APPARATUS, PRINTING SYSTEM, AND METHOD OF PRODUCING PRINTED MATTER

(71) Applicant: Yusuke Nemoto, Kanagawa (JP)

(72) Inventor: Yusuke Nemoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/482,689

(22) Filed: Sep. 10, 2014

(65) Prior Publication Data

US 2015/0077492 A1 Mar. 19, 2015

(30) Foreign Application Priority Data

Sep. 17, 2013 (JP) ..... 2013-192401
Jul. 30, 2014 (JP) ..... 2014-155460

(51) Int. Cl.
*B41J 11/00* (2006.01)
*B41M 5/00* (2006.01)

(52) U.S. Cl.
CPC ..... *B41J 11/0015* (2013.01); *B41M 5/0011* (2013.01)

(58) Field of Classification Search
CPC ..... B41J 11/0015; B41J 11/002; B41J 2/01; B41M 7/0072; B41M 5/0011
See application file for complete search history.

(56) References Cited

U.S. PATENT DOCUMENTS 4,911,995 A * 3/1990 Belanger ..... C23C 2/006 29/623.5
5,032,461 A * 7/1991 Shaw ..... B05D 1/60 118/50.1
5,314,539 A * 5/1994 Brown ..... B29C 59/14 118/718
5,742,888 A * 4/1998 Fuchiwaki ..... G03G 15/1605 399/308
6,070,045 A * 5/2000 Hara ..... G03G 15/2025 118/261
6,613,253 B1 * 9/2003 Negishi ..... B26D 1/0006 264/345
2003/0059548 A1 * 3/2003 Zaretsky ..... B05D 1/305 427/420

(Continued)

FOREIGN PATENT DOCUMENTS

JP 11-065179 3/1999
JP 2003-154255 5/2003

(Continued)

OTHER PUBLICATIONS

U.S. Appl. No. 14/208,418, filed Mar. 13, 2014.

(Continued)

*Primary Examiner* — Justin Seo
(74) *Attorney, Agent, or Firm* — Duft Bornsen & Fettig LLP

(57) ABSTRACT

A plasma treatment apparatus includes a discharge electrode; a dielectric roller which includes a rotatable counter electrode and a rotatable dielectric, the dielectric being at least provided on a surface with which a treatment target comes into contact; an adjusting roller configured to adjust a contact amount of the treatment target with respect to the dielectric roller; and a control unit configured to control the adjusting roller.

8 Claims, 11 Drawing Sheets

(56) References Cited

U.S. PATENT DOCUMENTS

| | | | | |
|---|---|---|---|---|
| 2007/0046720 | A1* | 3/2007 | Konno | B41J 11/002 347/21 |
| 2007/0058019 | A1 | 3/2007 | Saitoh et al. | |
| 2008/0239042 | A1* | 10/2008 | Gauss et al. | 347/101 |
| 2009/0252893 | A1* | 10/2009 | Ozaki | C23C 16/45595 427/579 |
| 2009/0290007 | A1 | 11/2009 | Saitoh et al. | |
| 2011/0063391 | A1 | 3/2011 | Miyamoto et al. | |
| 2011/0064489 | A1 | 3/2011 | Bisaiji et al. | |
| 2011/0209830 | A1* | 9/2011 | Hirono | C23C 16/505 156/345.37 |
| 2012/0014724 | A1* | 1/2012 | Yamashita | G03G 15/162 399/308 |
| 2013/0113869 | A1* | 5/2013 | Kobayashi | B41J 11/007 347/104 |
| 2013/0250017 | A1* | 9/2013 | Saitoh et al. | 347/101 |
| 2014/0078212 | A1 | 3/2014 | Nakai et al. | |
| 2014/0160197 | A1 | 6/2014 | Hirose et al. | |
| 2014/0168336 | A1* | 6/2014 | Mettu | B41J 2/01 347/103 |
| 2014/0198162 | A1* | 7/2014 | DiRubio | B41J 2/01 347/102 |

FOREIGN PATENT DOCUMENTS

| | | |
|---|---|---|
| JP | 2006-196255 | 7/2006 |
| JP | 2011-062820 | 3/2011 |
| JP | 4784218 | 7/2011 |
| JP | 4821594 | 9/2011 |

OTHER PUBLICATIONS

U.S. Appl. No. 14/204,112, filed Mar. 11, 2014.

* cited by examiner

PLASMA TREATMENT APPARATUS, PRINTING APPARATUS, PRINTING SYSTEM, AND METHOD OF PRODUCING PRINTED MATTER

CROSS-REFERENCE TO RELATED APPLICATIONS

The present application claims priority to and incorporates by reference the entire contents of Japanese Patent Application No. 2013-192401 filed in Japan on Sep. 17, 2013 and Japanese Patent Application No. 2014-155460 filed in Japan on Jul. 30, 2014.

BACKGROUND OF THE INVENTION

1. Field of the Invention

The present invention relates to a plasma treatment apparatus, a printing apparatus, a printing system, and a method of producing a printed matter.

2. Description of the Related Art

Conventional ink-jet recording devices have been centered on a shuttle system in which a head reciprocates in a widthwise direction of a recording medium represented by paper or a film, and thus have rarely improved a throughput according to high-speed printing. Thus, in recent years, to cope with the high-speed printing, one-pass system has been proposed in which a recording medium has been recorded at a time with multiple heads put side by side so as to cover the full width thereof.

The one-pass system is advantageous to speeding up, but has a problem, such as beading or bleeding, that, since time intervals at which neighboring dots are jetted are short and since the neighboring dots are jetted before ink jetted in dots previously permeates a recording medium, the union of the neighboring dots (hereinafter referred to as "jetted dot interference") occurs, and a quality of image is lowered.

Further, in ink-jet system based printing apparatuses, when printing is conducted on a non-permeable medium or a slow-permeable medium such as a film or coated paper, there is also a problem in that neighboring ink dots flow and unite to cause an image defect called beading or bleeding. As a conventional technique for addressing this, a method of taking measures to previously applying a pre-coating agent to the medium and to enhance aggregability and fixability of ink or a method of using ultraviolet (UV) curable ink is already known.

However, in the aforementioned method of previously applying the pre-coating agent to the printing medium, moisture of the pre-coating agent in addition to moisture of the ink also needs to be evaporated and dried, and a longer drying time or a large drying device is required. Further, in the method of using the pre-coating agent that is a supply product or the relatively expensive UV curable ink, there is a problem in that a printing cost is raised.

Therefore, there is a need for a plasma treatment apparatus, a printing apparatus, a printing system, and a method of producing a printed matter that are capable of producing a high-quality printed matter while inhibiting an increase in cost.

SUMMARY OF THE INVENTION

According to an embodiment, a plasma treatment apparatus includes a discharge electrode; a dielectric roller which includes a rotatable counter electrode and a rotatable dielectric, the dielectric being at least provided on a surface with which a treatment target comes into contact; an adjusting roller configured to adjust a contact amount of the treatment target with respect to the dielectric roller; and a control unit configured to control the adjusting roller.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
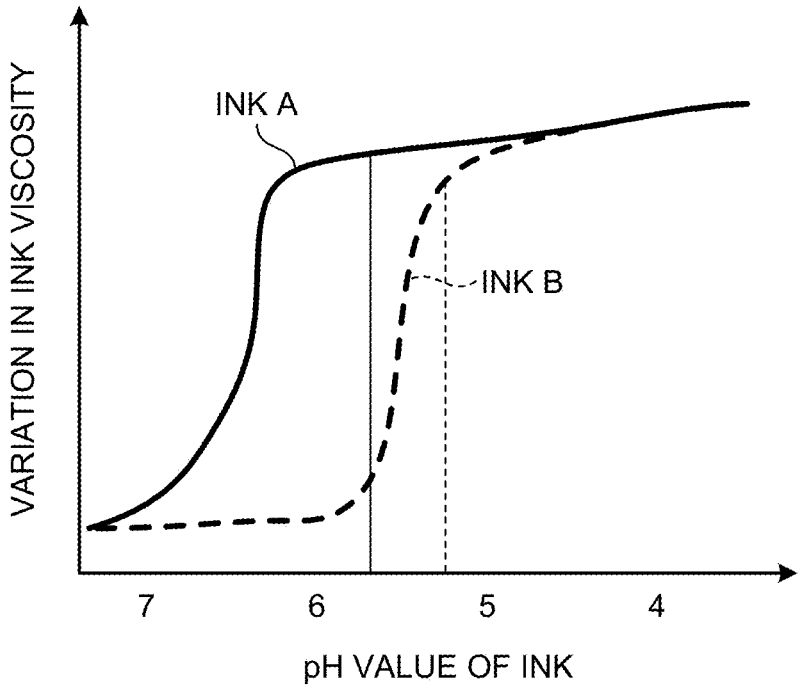
FIG. 1 is a view illustrating an example of a relation between a pH value of ink and a viscosity of ink in an embodiment.

Hereinafter, preferred embodiments of the present invention will be described in detail with reference to the accompanying drawings. The embodiments to be described below are the preferred embodiments of the present invention, and are thus given technically preferable various limitations. However, the scope of the present invention is not unreasonably limited by the following description. Further, the whole configurations described in the present embodiments are not essential components of the present invention.

In the embodiments below, to aggregate ink pigments while preventing the ink pigments from being dispersed just after ink is landed on a treatment target (also called a recording medium or a printing medium), a surface of the treatment target is acidified. As an acidifying means, plasma treatment is given as an example.

Further, in the embodiments below, by controlling wettability of the treatment target surface having been subjected to the plasma treatment, and aggregability or permeability of the ink pigments caused by a decrease in pH value, roundness of an ink dot (hereinafter referred to simply as "dot") is improved, and the union of the dots is prevented to increase sharpness or a color gamut of the dot. Thereby, an image defect called beading or bleeding is addressed, so that a printed matter on which a high-quality image is formed can be obtained. Further, as an aggregation thickness of the pigments on the treatment target is uniformly thinned, it is possible to reduce an amount of ink droplet and to also decrease ink drying energy and a printing cost.

In the plasma treatment acting as the acidifying means (process), the treatment target is irradiated with plasma in the atmosphere. Thereby, the plasma reacts with polymers of the treatment target surface and hydrophilic functional groups are formed. Specifically, electrons e emitted from a discharge electrode are accelerated in an electric field, exciting and ionizing atoms or molecules in the atmosphere. Electrons are also emitted from the ionized atoms or molecules, and high-energy electrons are increased. As a result, a streamer discharge (plasma) occurs. Polymeric bonds of the surface of the treatment target (for instance, coated paper) (wherein a coating layer of the coated paper is immobilized by calcium carbonate and starch as a binder, but the starch has a polymeric structure) are cut by high-energy electrons caused by the streamer discharge, and are recombined with an oxygen radical O* or a hydroxyl radical (—OH), and ozone $O_3$ in a gas phase. These processes are called the plasma treatment. Thereby, polar functional groups such as hydroxyl groups or carboxyl groups are formed on the surface of the treatment target. As a result, hydrophilicity or acidity is given to the surface of the printing medium. Due to an increase in carboxyl group, the printing medium surface is acidified (reduced in pH value).

The dots adjacent to each other on the treatment target are wetted and spread by a rise in hydrophilicity, and thereby a color mixture between the dots occurs. It has been found that, to prevent the color mixture, it was also important to aggregate colorants (for instance, pigments or dyes) in the dot or to dry or permeate a vehicle into the treatment target more quickly than the vehicle is wetted and spread. Thus, in the embodiment, as pretreatment of an ink-jet recording process, an acidifying process of acidifying the treatment target surface is performed.

The acidification in the present invention refers to lowering the pH value of the printing medium surface to a pH value at which the pigments included in the ink are aggregated. To lower the pH value is to raise a concentration of hydrogen ions $H^+$ in the object. The pigments in the ink prior to contact with the treatment target surface are charged negatively, and the pigments are dispersed in the vehicle. In FIG. 1, an example of a relation between a pH value of the ink and a viscosity of the ink is illustrated. As illustrated in FIG. 1, the lower the pH value of the ink, the higher the viscosity of the ink. This is because, as the acidity of the ink becomes higher, the pigments charged negatively in the vehicle of the ink are electrically neutralized, and result in being aggregated. Thus, for example, in the graph illustrated in FIG. 1, the pH value of the printing medium surface is lowered such that the pH value of the ink becomes a value corresponding to a necessary viscosity. Thereby, the viscosity of the ink can be raised. This is because, when the ink is attached to the printing medium surface that is acid, the pigments are electrically neutralized by the hydrogen ions $H^+$ of the printing medium surface, so that the pigments are aggregated. Thereby, it is possible to prevent the color mixture between the neighboring dots, and to prevent the pigments from permeating the printing medium deeply (what is more, up to a rear face). However, to lower the pH value of the ink so as to be the pH value corresponding to the necessary viscosity, the pH value of the printing medium surface needs to be lower than the pH value corresponding to the necessary viscosity.

Further, the pH value for making the ink to the necessary viscosity differs depending on characteristics of the ink. That is, if there is ink in which, as illustrated in ink A of FIG. 1, pigments are aggregated at a pH value close to relative neutrality and a viscosity is raised, ink in which a lower pH value than the ink A is required to aggregate the pigments is also present as illustrated in ink B having characteristics different from those of the ink A.

The behavior of the colorant being aggregated in the dot, a drying rate of the vehicle, or a permeating rate of the vehicle into the treatment target differs depending on an amount of droplet changed depending on a size (small, medium, or large droplet) of the dot, or a type of the treatment target. Thus, in the embodiment below, the plasma energy amount in the plasma treatment may be controlled at an optimum value according to a type of the treatment target or a printing mode (droplet amount).

Figure 2:
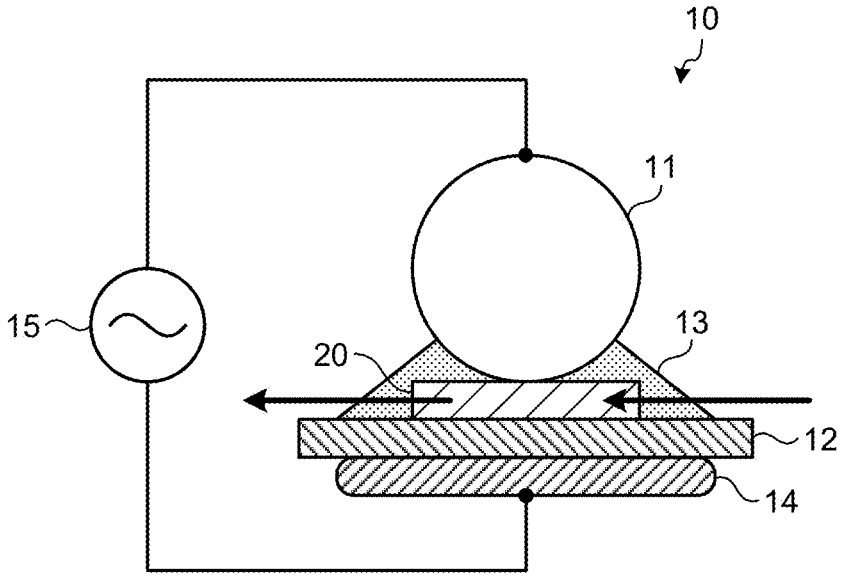
FIG. 2 is a schematic view illustrating an example of a plasma treatment apparatus according to the embodiment.

FIG. 2 is a schematic view for describing an outline of an acidifying process employed in an embodiment. As illustrated in FIG. 2, in the acidifying process employed in the embodiment, a plasma treatment apparatus 10 equipped with a discharge electrode 11, a counter electrode 14, a dielectric 12, and a high-frequency high-voltage power supply 15 is used. In the plasma treatment apparatus 10, the dielectric 12 is disposed between the discharge electrode 11 and the counter electrode 14. The discharge electrode 11 and the counter electrode 14 may be either electrodes whose metal portions are exposed or electrodes covered with a dielectric or an insulator such as insulating rubber or ceramic. Further, the dielectric 12 disposed between the discharge electrode 11 and the counter electrode 14 may be an insulator such as polyimide, silicon, or ceramic. When a corona discharge is employed as the plasma treatment, the dielectric 12 may not be provided. However, in the case of employing, for instance, a dielectric-barrier discharge, it may be preferable to provide the dielectric 12. In this case, when the dielectric 12 is disposed such that a position thereof is close to or comes into contact with the side of the counter electrode 14 rather than the side of the discharge electrode 11, the region of a creeping discharge is widened, and thus an effect of the plasma treatment can be further enhanced. Further, the discharge electrode 11 and the counter electrode 14 (or the dielectric 12 in the case of the electrode of the side at which the dielectric 12 is provided) may be disposed at positions at which they come into contact with the treatment target 20 passing between the two electrodes or at positions at which they do not come into contact with treatment target 20.

The high-frequency high-voltage power supply 15 applies a pulse voltage of high-frequency high-voltage between the discharge electrode 11 and the counter electrode 14. The pulse voltage has a voltage value of, for instance, about 10 kilovolts (kV) peak to peak, and a frequency thereof can be set to, for instance, about 20 kilohertz (kHz). Such a pulse voltage of high-frequency high-voltage is supplied between the two electrodes, and thereby atmospheric non-equilibrium plasma 13 is generated between the discharge electrode 11 and the dielectric 12. The treatment target 20 passes between the discharge electrode 11 and the dielectric 12 during the generation of the atmospheric non-equilibrium plasma 13. Thereby, a surface of the treatment target 20 which is close to the discharge electrode 11 is subjected to plasma treatment.

In the plasma treatment apparatus 10 illustrated in FIG. 2, the discharge electrode 11 is employed in a rotary type, and the dielectric 12 is employed in a belt conveyor type. The treatment target 20 is sandwiched and conveyed between the rotating discharge electrode 11 and the dielectric 12, thereby passing through the atmospheric non-equilibrium plasma 13. Thereby, the surface of the treatment target 20 comes into contact with the atmospheric non-equilibrium plasma 13, and undergoes uniform plasma treatment. However, the plasma treatment apparatus employed in the embodiment is not limited to the configuration illustrated in FIG. 2. For example, various modifications such as a configuration in which the discharge electrode 11 is close to the treatment target 20 with no contact, and a configuration in which the discharge electrode 11 is mounted on the same carriage as the ink-jet head are possible. Further, without being limited to the belt conveyor type dielectric 12, the dielectric 12 may also be employed in a flat plate type.

Figure 3:
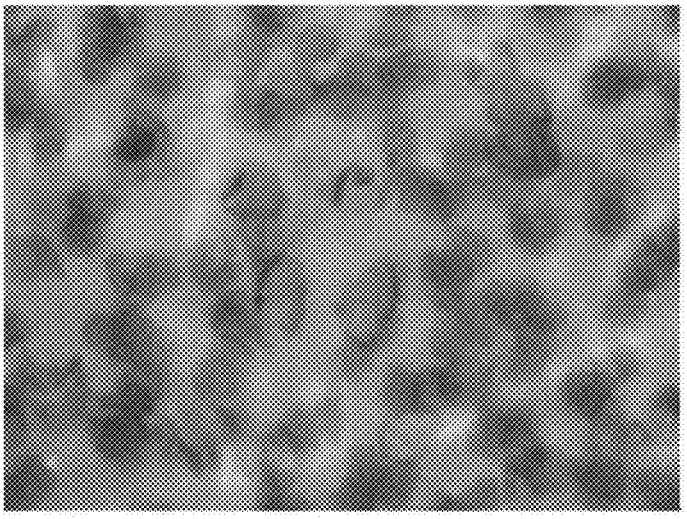
FIG. 3 is an enlarged view of an image obtained by imaging an image forming face of a printed matter obtained by performing an ink-jet recording process on a treatment target that is not subjected to plasma treatment according to an embodiment.
Figure 4:
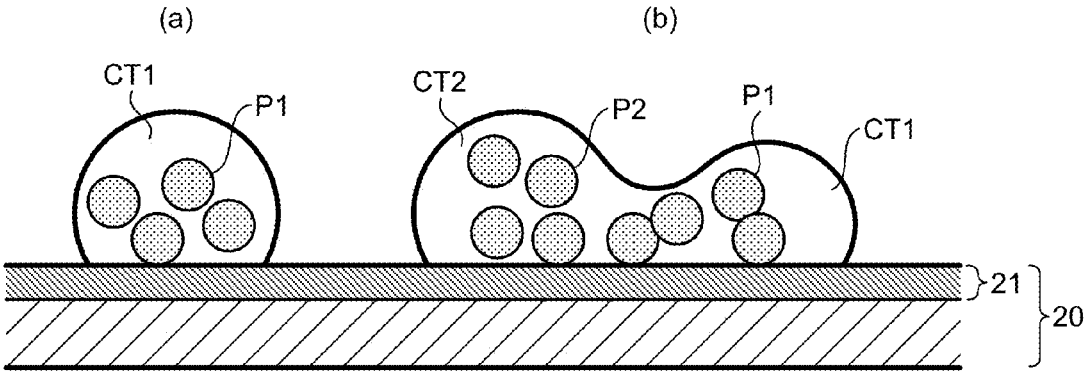
FIG. 4 is a schematic view illustrating an example of a dot formed on the image forming face in the printed matter illustrated in FIG. 3.
Figure 5:
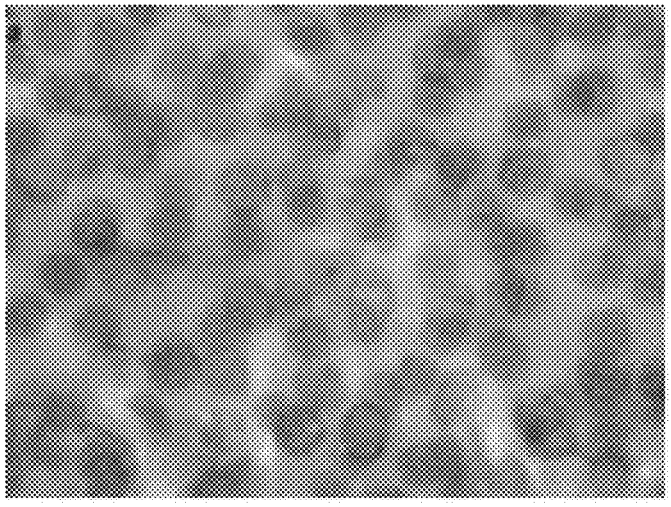
FIG. 5 is an enlarged view of an image obtained by imaging the image forming face of the printed matter obtained by performing the ink-jet recording process on the treatment target that is subjected to the plasma treatment according to the embodiment.
Figure 6:
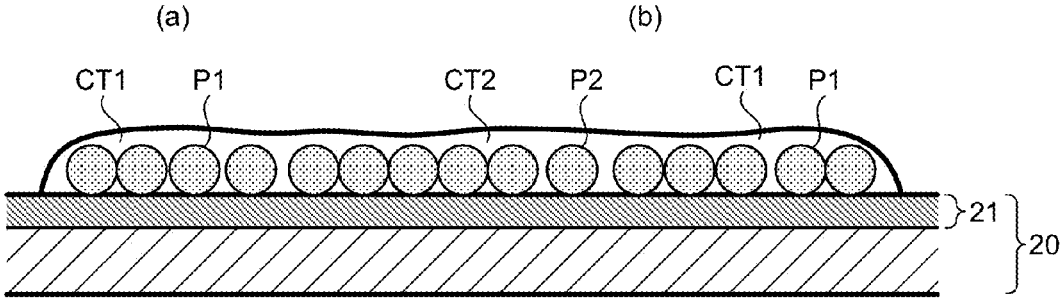
FIG. 6 is a schematic view illustrating an example of a dot formed on the image forming face in the printed matter illustrated in FIG. 5.

Here, a difference of the printed matter between the case of performing the plasma treatment according to the embodiment and the reverse case will be described using FIGS. 3 to 6. FIG. 3 is an enlarged view of an image obtained by imaging an image forming face of a printed matter obtained by performing an ink-jet recording process on a treatment target that is not subjected to the plasma treatment according to the embodiment. FIG. 4 is a schematic view illustrating an example of a dot formed on the image forming face in the printed matter illustrated in FIG. 3. FIG. 5 is an enlarged view of an image obtained by imaging the image forming face of the printed matter obtained by performing the ink-jet recording process on the treatment target that is subjected to the plasma treatment according to the embodiment. FIG. 6 is a schematic view illustrating an example of a dot formed on the image forming face in the printed matter illustrated in FIG. 5. A desktop ink-jet recording device was used when obtaining printed matters illustrated in FIGS. 3 and 5. Further, common coated paper having a coating layer 21 was used in the treatment target 20.

Coated paper that is not subjected to the plasma treatment according to the embodiment has bad wettability of the coating layer present on the surface of the coated paper. For this reason, in an image formed by performing an ink-jet recording process on the coated paper that is not subjected to the plasma treatment, for example, as illustrated in FIGS. 3 and 4, a shape of a dot (shape of a vehicle CT1) attached to the surface of the coated paper when the dot is landed is distorted. Further, if a neighboring dot is formed with the dot dried insufficiently, vehicles CT1 and CT2 are united, as illustrated in FIGS. 3 and 4, when the neighboring dot is landed onto the coated paper. Thereby, movement (color mixture) pigments P1 and P2 between the dots takes place. As a result, concentration unevenness may be caused by, for instance, beading.

In contrast, coated paper that is subjected to the plasma treatment according to the embodiment is improved in wettability of the coating layer present on the surface of the coated paper. For this reason, in an image formed by performing an ink-jet recording process on the coated paper that is subjected to the plasma treatment, for example, as illustrated in FIG. 5, the vehicle CT1 is spread on the surface of the coated paper in a perfectly circular shape that is relatively flat. Thereby, the dot has a flat shape as illustrated in FIG. 6. Further, since the coated paper surface is acidified by a polar functional group formed by the plasma treatment, ink pigments are electrically neutralized. Thus, the pigments P1 are aggregated, and a viscosity of the ink is raised. Thereby, as illustrated in FIG. 6, even when the vehicles CT1 and CT2 are united, the movement (color mixture) of pigments P1 and P2 between the dots is suppressed. Further, since the polar functional group is also generated in the coating layer, permeability of the vehicle CT1 is raised. Thereby, the vehicle can be dried within a relatively short time. The dots spread in the perfectly circular shape by the wettability improvement are aggregated with the permeation. Thereby, the pigments P1 can be uniformly aggregated in a height direction, and the concentration unevenness can be inhibited from being caused by, for instance, beading. FIGS. 4 and 6 are schematic views. In fact, even in the case of FIG. 6, the pigments are aggregated in layers.

In this way, in the treatment target 20 that is subjected to the plasma treatment according to the embodiment, a hydrophilic functional group is generated on the surface of the treatment target 20 by the plasma treatment, and the wettability is improved. Further, as the result that the polar functional group is formed by the plasma treatment, the surface of the treatment target 20 is acidified. Thereby, with the uniform spread of landed ink on the surface of the treatment target 20, negatively charged pigments are neutralized on the surface of the treatment target 20, and are thereby aggregated to raise the viscosity. Consequently, even when the dots are united, the movement of the pigments can be suppressed. Further, as the polar functional group is also generated inside the coating layer formed on the surface of the treatment target 20, the vehicle rapidly permeates into the treatment target 20. Thereby, it is possible to reduce a drying time. In other words, the dots spread in the perfectly circular shape by the increase of the wettability are permeated in the state in which the movement of the pigments is suppressed by aggregation. Thereby, the dots can maintain a shape close to a perfect circle.

Figure 7:
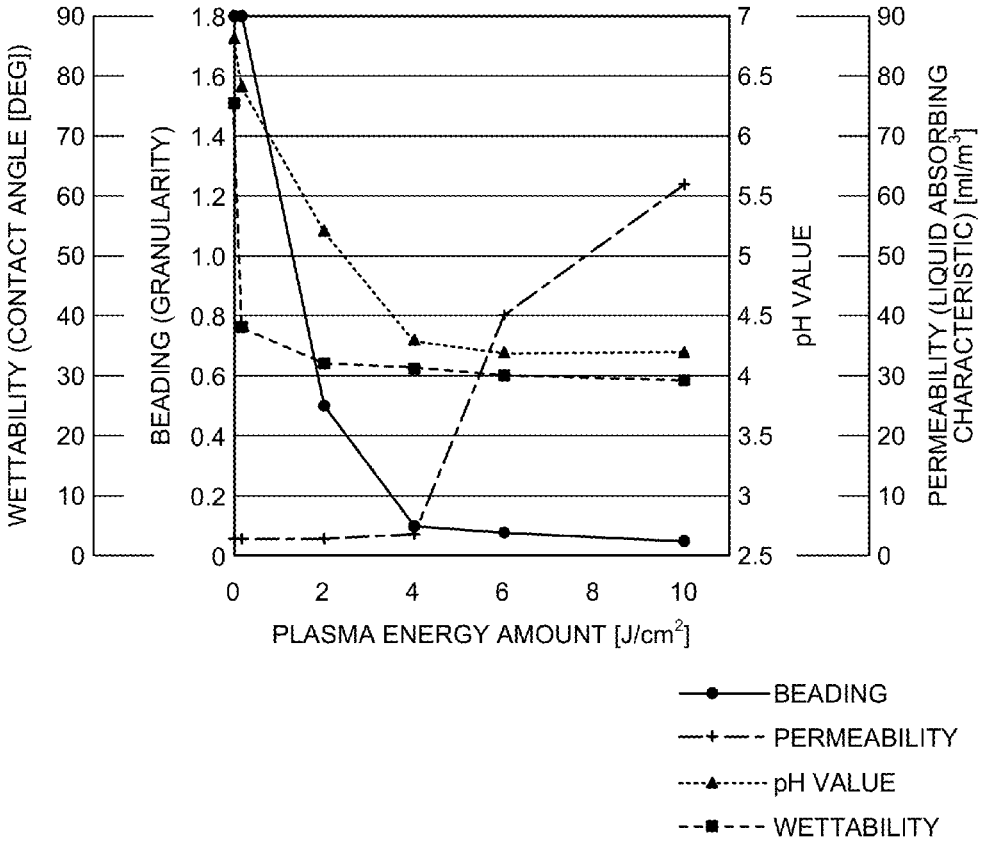
FIG. 7 is a graph illustrating a relation between an amount of plasma energy, and wettability, beading, a pH value, and permeability of a treatment target surface according to the embodiment.

FIG. 7 is a graph illustrating a relation between an amount of plasma energy, and wettability, beading, a pH value, and permeability of a treatment target surface according to an embodiment. In FIG. 7, it is illustrated how surface characteristics (wettability, beading, a pH value, and permeability (liquid absorbing characteristic)) when printed onto the coated paper acting as the treatment target 20 are changed depending on an amount of plasma energy. When the evaluation illustrated in FIG. 7 is obtained, aqueous pigment ink (alkaline ink in which the negatively charged pigments are dispersed) having a characteristic in which the pigments are aggregated by an acid was used as the ink.

As illustrated in FIG. 7, the wettability of the coated paper surface sharply gets better when the plasma energy amount is a low value (for instance, about 0.2 J/cm$^2$ or less), but is not much improved even when the plasma energy amount is increased more than that. On the other hand, the pH value of the coated paper surface is reduced by increasing the plasma energy amount to some extent. However, when the plasma energy amount exceeds a certain value (for instance, about 4 J/cm$^2$), the pH value of the coated paper surface gets saturated. Further, the permeability (liquid absorbing characteristic) sharply gets better from the time when the reduction of the pH is saturated (for instance, about 4 J/cm$^2$). However, this phenomenon differs depending on a polymeric component contained in the ink.

As a result, since the permeability (liquid absorbing characteristic) begins to get better (for instance, about 4 J/cm$^2$), a value of the beading (granularity) sharply gets better. Here, the beading (granularity) is to numerically represent the roughness of an image, and to express a variation in density as standard deviation of an average density. In FIG. 7, a density of a solid image of a color composed of dots of two or more colors is sampled multiple times, and a standard deviation of the density is expressed as the beading (granularity). In this way, since the ink discharged to the coated paper subjected to the plasma treatment according to the embodiment is permeated while being spread and aggregated in a perfect circle, the beading (granularity) of the image is improved.

As described above, in the relation between the characteristics of the surface of the treatment target 20 and the image quality, the wettability of the surface is improved, and thus the roundness of the dot is improved. As the reason, it is considered that the wettability of the surface of the treatment target 20 is improved and uniformed by the increased surface roughness and the generated hydrophilic polar functional group that are caused by the plasma treatment. Further, it is considered to be one factor that water repellant factors such as dust, oil, and calcium carbonate of the surface of the treatment target 20 are excluded by the plasma treatment. In other words, it is considered that unstable factors of the surface of the treatment target 20 are removed while the wettability of the surface of the treatment target 20 is improved, so that the droplets are uniformly spread in a circumferential direction, and the roundness of the dot is improved.

Further, as the surface of the treatment target 20 is acidified (reduced in pH), the improvement in the aggregation and permeability of the ink pigment and the permeation of the vehicle into the coating layer take place. Thereby, the pigment concentration of the surface of the treatment target 20 is raised. As such, even when the dots are united, the movement of the pigments can be suppressed. As a result, mixture of the pigments can be suppressed, and the pigments can be uniformly precipitated and aggregated on the surface of the treatment target 20. However, a suppressing effect of the pigment mixture differs depending on a composition of the ink or a droplet amount of the ink. For example, when the droplet amount of the ink is a small droplet amount, the mixture of the pigments caused by the union of the dots hardly occurs compared to the case of a large droplet amount. This is because the vehicle is more rapidly dried and permeated when the vehicle amount is a small droplet amount, and because the pigments can be aggregated by a little pH reaction. Further, the effect of the plasma treatment is changed by a type or an environment (humidity, etc.) of the treatment target 20. Thus, the amount of plasma energy in the plasma treatment may be controlled at an optimum value depending on the droplet amount or the type or environment of the treatment target 20. As a result, surface modification efficiency of the treatment target 20 is improved, and further energy saving may be achieved.

Figure 8:
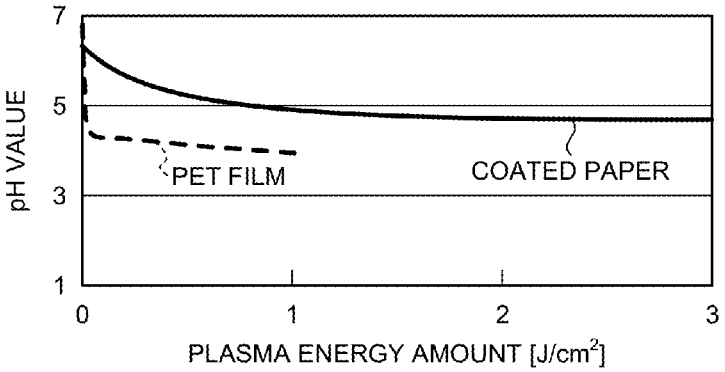
FIG. 8 is a view illustrating an example of a relation between an amount of plasma energy and a pH value of a treatment target surface for each medium.

Further, FIG. 8 is a view illustrating a relation between an amount of plasma energy and a pH value according to an embodiment. Typically, pH is generally measured in a solution. In recent years, however, measurement of pH of a solid surface has been possible, and a measuring instrument therefor is, for example, pH Meter B-211 manufactured by HORIBA Ltd.

In FIG. 8, the solid line indicates plasma energy dependency of a pH value of coated paper, and the dotted line indicates plasma energy dependency of a pH value of a polyethylene terephthalate (PET) film. As illustrated in FIG. 8, in comparison with the coated paper, the PET film acidifies a small plasma energy amount. However, even in the coated paper, the plasma energy amount when acidified was equal to or less than about 3 J/cm$^2$. Then, when an image was recorded on the treatment target 20 in which a pH value was not more than 5 using an ink-jet processing apparatus that discharged alkaline aqueous pigment ink, dots of the formed image had a shape close to a perfect circle. Further, no mixture of the pigments caused by the union of the dots was present, and a good image having no bleeding was obtained (see FIG. 5).

Next, a plasma treatment apparatus, a printing apparatus, a printing system, and a method of producing a printed matter according to embodiments of the present invention will be described in detail with reference to the drawings.

In the present embodiments, an image forming apparatus having four discharge heads (recording heads or ink heads) for four colors of black (K), cyan (C), magenta (M) and yellow (Y) will be described, but it is not limited to four discharge heads. That is, the image forming apparatus may further have discharge heads corresponding to green (G), red (R) and other colors, or may have a discharge head for black (K) only. Here, in the following description, K, C, M and Y correspond to black, cyan, magenta, and yellow, respectively.

Further, in the present embodiments, a continuous form (hereinafter referred to as "roll sheet") wound in a roll shape is used as the treatment target. However, without being limited thereto, for example, any recording medium such as a cut sheet capable of forming an image may be used. Thus, as a type of paper, for instance, plain paper, premium grade paper, recycled paper, thin paper, thick paper, and coated paper may be used. Further, an OHP sheet, a synthetic resin film, a metal thin film, and an object having a surface on which an image can be formed with ink can also be used as the treatment target. When the paper is non-permeable or slow-permeable paper such as coated paper, the present invention further exerts an effect. Here, the roll sheet may be a continuous form (continuous form paper or continuous stationary) having cuttable perforations formed at given intervals. In this case, a page in the roll sheet is regarded to be, for instance, a region sandwiched between the perforations of a predetermined interval.

Figure 9:
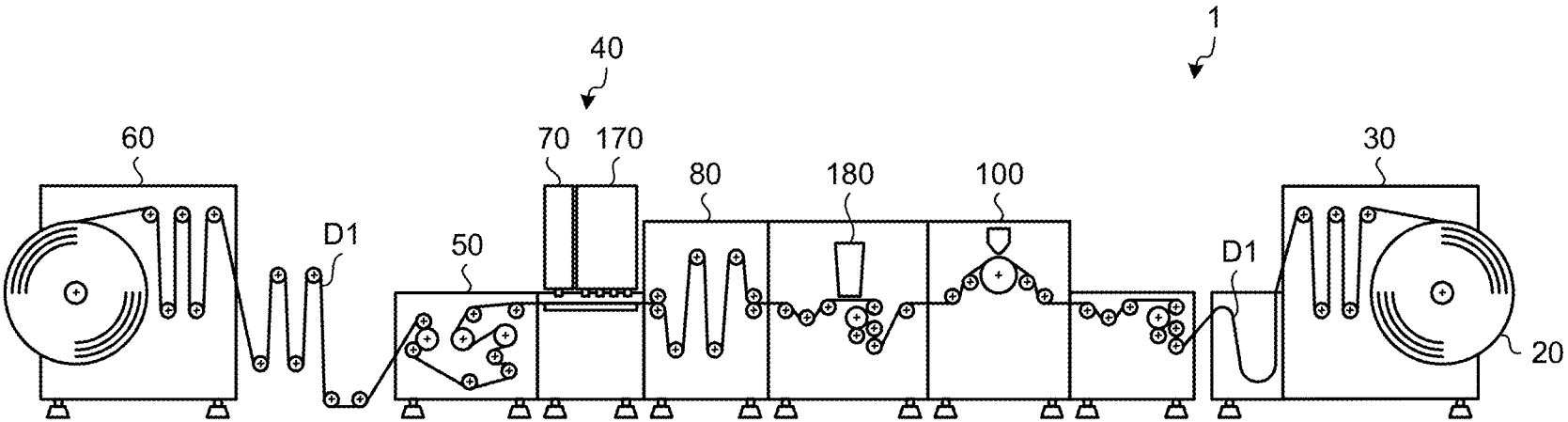
FIG. 9 is a schematic view illustrating a schematic configuration of a printing apparatus (system) according to the embodiment.

FIG. 9 is a schematic view illustrating a schematic configuration of the printing apparatus (system) according to the present embodiment. As illustrated in FIG. 9, the printing apparatus (system) 1 has a carrying-in unit 30 that carries in (out) a treatment target (roll sheet) 20 along a conveying path D1, a plasma treatment apparatus 100 that performs plasma treatment serving as pretreatment on the treatment target 20 that has been carried in, and an image forming apparatus 40 that forms an image on a surface of the treatment target 20 subjected to the plasma treatment. These apparatuses may be present in separate casings to constitute a system as a whole, or may be placed in the same casing to form the printing apparatus. Further, when these apparatuses are constituted as the printing system, a control unit controlling the system in whole or in part may be included in any of the apparatuses or may be provided in an independent separate casing.

An ink-jet recording device 170 of the image forming apparatus 40 is equipped with an ink-jet head. The ink-jet head includes, for instance, a plurality of same color heads (for instance, four colors×four heads) in order to obtain a faster print speed. Further, to form an image having a high resolution (for instance, 1200 dpi) at a high speed, an ink discharge nozzle of the head for each color is offset and fixed to correct an interval. Further, the ink-jet head is adapted to be drivable with multiple drive frequencies so as to correspond to three types of capacities of a dot (droplet) of the ink discharged from each nozzle, which are called large, medium, and small droplets.

The ink-jet head of the ink-jet recording device 170 is disposed downstream relative to the plasma treatment apparatus 100 on the conveying path of the treatment target 20. The ink-jet recording device 170 forms an image by discharging the ink to the treatment target 20 subjected to the pretreatment (acidifying process) by the plasma treatment apparatus 100.

A buffer unit 80 is provided between the plasma treatment apparatus 100 and the ink-jet recording device 170 in order to adjust a feed rate at which the treatment target 20 going through the pretreatment such as the plasma treatment is fed to the ink-jet recording device 170. Further, the image forming apparatus 40 includes the ink-jet recording device 170 that forms an image on the treatment target 20 subjected to the plasma treatment by ink-jet treatment. The image forming apparatus 40 may further include a posttreatment unit 70 that performs posttreatment on the treatment target 20 on which the image is formed.

The printing apparatus (system) 1 may include a drying unit 50 that dries the treatment target 20 subjected to the posttreatment, and a carrying-out unit 60 that carries out the treatment target 20 on which the image is formed (according to circumstances, further subjected to the posttreatment). Further, the printing apparatus (system) 1 may further include a pre-coating treatment unit (not illustrated) that applies a treatment liquid called a pre-coating agent containing a polymeric material to the surface of the treatment target 20, in addition to the plasma treatment apparatus 100 as the pretreatment unit performing the pretreatment on the treatment target 20. Further, a pH detecting unit 180 may be provided between the plasma treatment apparatus 100 and the image forming apparatus 40 in order to detect a pH value of the surface of the treatment target 20 subjected to the pretreatment by the plasma treatment apparatus 100.

The pH detecting unit 180 may be disposed downstream relative to the plasma treatment apparatus 100 and a pre-coating device (not illustrated), and may detect the pH value of the surface of the treatment target 20 subjected to the pretreatment (acidifying process) by the plasma treatment apparatus 100 and/or the pre-coating device. In this case, the pH value of the surface of the treatment target 20 after the pretreatment may be adjusted by conducting feedback control over the plasma treatment apparatus 100 and/or the pre-coating device (not illustrated) based on the pH value input from the pH detecting unit 180.

Furthermore, the printing apparatus (system) 1 includes a control unit (not illustrated) that controls an operation of each unit. The control unit may be connected to, for instance, a print control device that generates raster data from image data to be printed. The print control device may be provided inside the printing apparatus (system) 1 or outside the printing apparatus (system) 1 via a network such as the Internet or a local area network (LAN).

In the embodiment, in the printing apparatus (system) 1 illustrated in FIG. 9, as described above, an acidifying process of acidifying the surface of the treatment target is performed prior to an ink-jet recording process. For the acidifying process, for instance, atmospheric non-equilibrium plasma treatment using a dielectric barrier discharge may be employed. The acidifying process caused by atmospheric non-equilibrium plasma is one of favorable methods as a plasma treatment method for the treatment target such as a recording medium, because an electron temperature is extremely high and a gas temperature is close to room temperature.

To stably generate the atmospheric non-equilibrium plasma in a wide range, the atmospheric non-equilibrium plasma treatment employing dielectric barrier discharge of a streamer breakdown type may be performed. The dielectric barrier discharge of the streamer breakdown type can be obtained, for instance, by applying an alternating high voltage between electrodes covered with a dielectric.

A method of generating the atmospheric non-equilibrium plasma may use various dielectric barrier discharges without being limited to the aforementioned dielectric barrier discharge of the streamer breakdown type.

Subsequently, a specific example of the plasma treatment apparatus 100 illustrated in FIG. 9 will be described in detail using the drawings. The plasma treatment apparatus 100 according to the embodiment controls a width (hereinafter referred to as a "treatment width") at which the treatment target 20 is in contact with the atmospheric non-equilibrium plasma generated between the discharge electrode and the counter electrode, thereby adjusting an amount of plasma energy for treating the treatment target 20. The treatment width is a width of the treatment target 20 whose lengthwise direction runs along the conveying path D1.

First Specific Example

Figure 10:
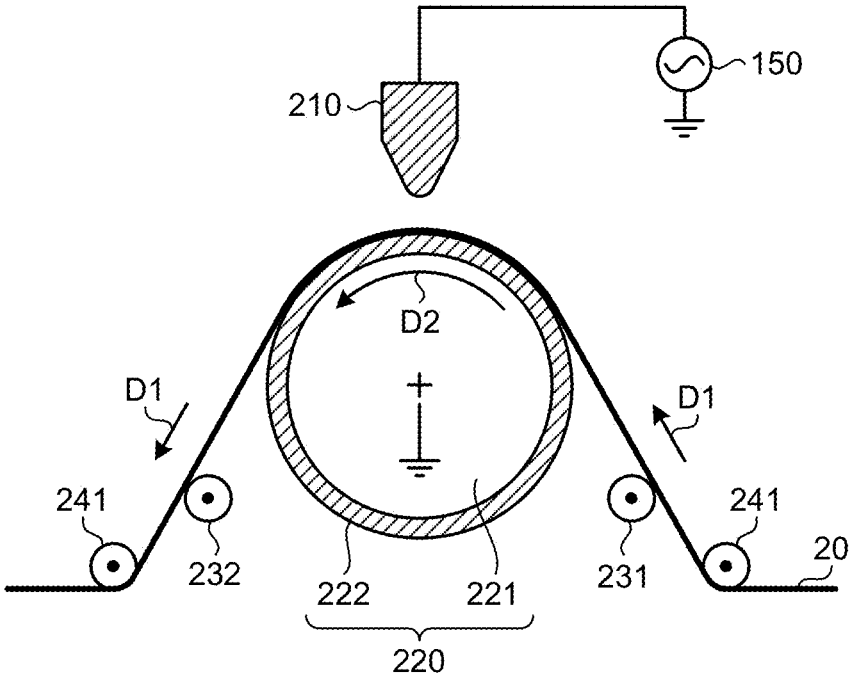
FIG. 10 is a schematic view illustrating an example of a schematic configuration of a discharge unit in a plasma treatment apparatus according to a first modification.

FIG. 10 is a schematic view illustrating a schematic configuration of a discharge unit in a plasma treatment apparatus according to a first specific example. As illustrated in FIG. 10, the discharge unit in the plasma treatment apparatus according to the first specific example includes a discharge electrode 210, a dielectric roller 220, a high-frequency high-voltage power supply 150, winding rollers 241 for winding the treatment target 20 around the dielectric roller 220, and adjusting rollers 231 and 232 for adjusting an amount of winding of the treatment target 20 around the dielectric roller 220, in place of the discharge electrode 11, the counter electrode 14, the dielectric 12, and the high-frequency high-voltage power supply 15 in the plasma treatment apparatus 10 illustrated in FIG. 2.

The dielectric roller 220 includes a cylindrical counter electrode 221 that is rotatable in the direction D2 around an axis perpendicular to a direction in which the treatment target 20 is conveyed along the conveying path D1, and a dielectric 222 that is provided to cover at least a side of the counter electrode 221.

In the plasma treatment apparatus 100, the dielectric 222 is disposed between the discharge electrode 210 and the counter electrode 221. The discharge electrode 210 may be either an electrode whose metal portion is exposed or an electrode covered with a dielectric or an insulator such as insulating rubber or ceramic. Further, the dielectric 222 provided on the outer periphery of the counter electrode 221 may be an insulator such as polyimide, silicon, or ceramic. The dielectric 222 may be provided to be close to or be in contact with the discharge electrode 210. Instead, when the dielectric 222 is provided to be close to or be in contact with the counter electrode 221, the region of a creeping discharge is widened, and thus an effect of the plasma treatment can be further enhanced. Further, the discharge electrode 210 and the counter electrode 221 (or the dielectric 222 in the case of the electrode of the side at which the dielectric 222 is provided) may be provided at positions at which they come into contact with the treatment target 20 passing between the two electrodes or at positions at which they do not come into contact with the treatment target 20.

The high-frequency high-voltage power supply 150 applies a pulse voltage of high-frequency high-voltage between the discharge electrode 210 and the counter electrode 221. The pulse voltage has a voltage value of, for instance, about 10 kilovolts (kV) peak to peak, and a frequency thereof can also be set to, for instance, about 20 kilohertz (kHz). Such a pulse voltage of high-frequency high-voltage is supplied between the two electrodes, and thereby atmospheric non-equilibrium plasma 13 is generated between the discharge electrode 210 and the dielectric 222. The treatment target 20 passes between the discharge electrode 210 and the dielectric 222 during the generation of the atmospheric non-equilibrium plasma 13. Thereby, a surface of the treatment target 20 which is close to the discharge electrode 210 is subjected to plasma treatment. However, in the plasma treatment apparatus employed in the embodiment, the discharge electrode 210 may be variously modified, for instance, may be configured to be mounted on the same carriage with the ink-jet head.

Further, the dielectric 222 may be provided for a surface of the dielectric roller 220 with which at least the treatment target 20 is in contact. The treatment target 20 passes between the winding rollers 241 and the dielectric roller 220 in such a manner to come into contact with the dielectric roller 220 from the side of the discharge electrode 210. Predetermined tension is applied to the treatment target 20 along the conveying path D1. Thereby, when the treatment target 20 passes between the winding rollers 241 and the dielectric roller 220, the treatment target 20 can come into contact with the dielectric roller 220 from the side of the discharge electrode 210 without becoming loose.

The adjusting rollers 231 and 232 adjust a contact width of the treatment target 20 with respect to the dielectric roller 220. Like the treatment width, the contact width is the width of the treatment target 20 whose lengthwise direction runs along the conveying path D1. For example, as illustrated in FIG. 10, the adjusting rollers 231 and 232 move to raise the treatment target 20 from the opposite side of the discharge electrode 210 across the treatment target 20, thereby adjusting the contact width (contact amount) of the treatment target 20 with respect to the dielectric roller 220. However, without being limited thereto, the adjusting rollers 231 and 232 may move to push the treatment target 20 against the dielectric roller 220 from a direction of the treatment target 20, thereby adjusting the contact width of the treatment target 20 with respect to the dielectric roller 220.

Figure 11:
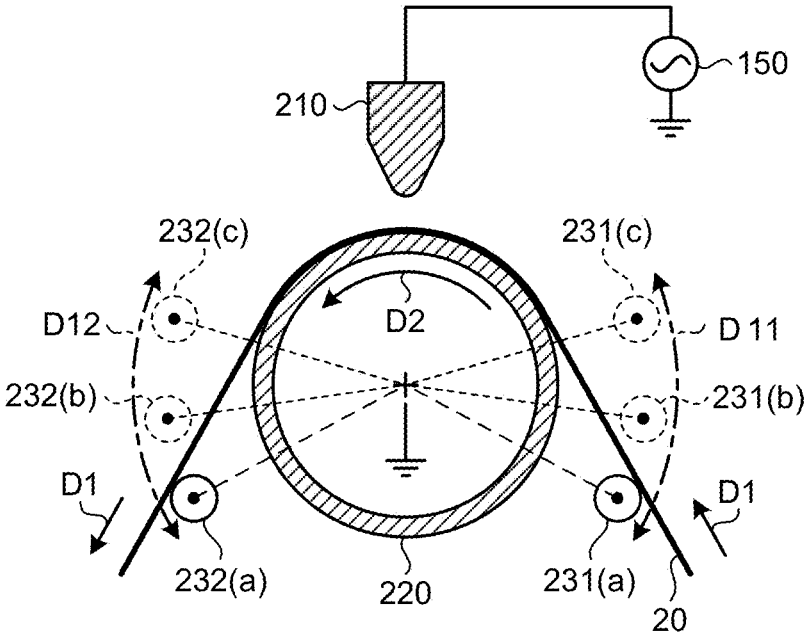
FIG. 11 is a view illustrating a positional relation between a treatment target and a dielectric roller when an adjusting roller is present at a lowermost point in the first modification.
Figure 12:
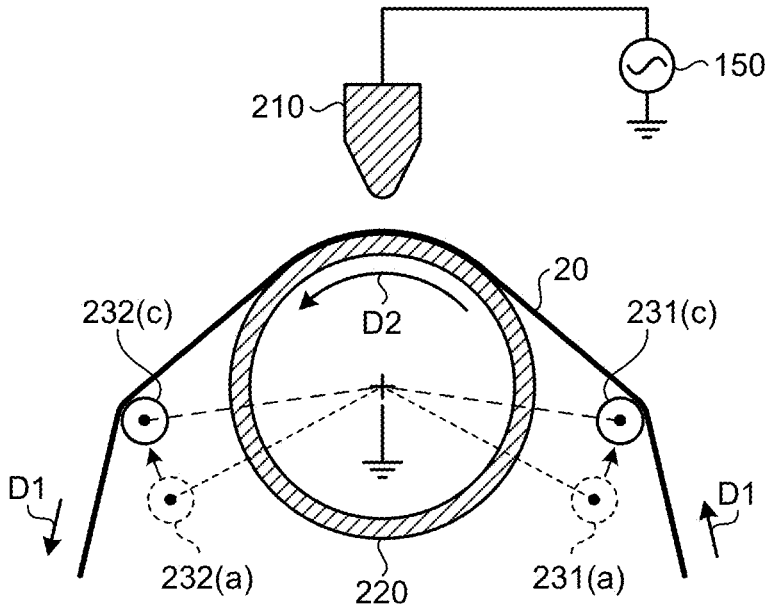
FIG. 12 is a view illustrating a positional relation between a treatment target and a dielectric roller when an adjusting roller is present between a lowermost point and an uppermost point in the first modification.
Figure 13:
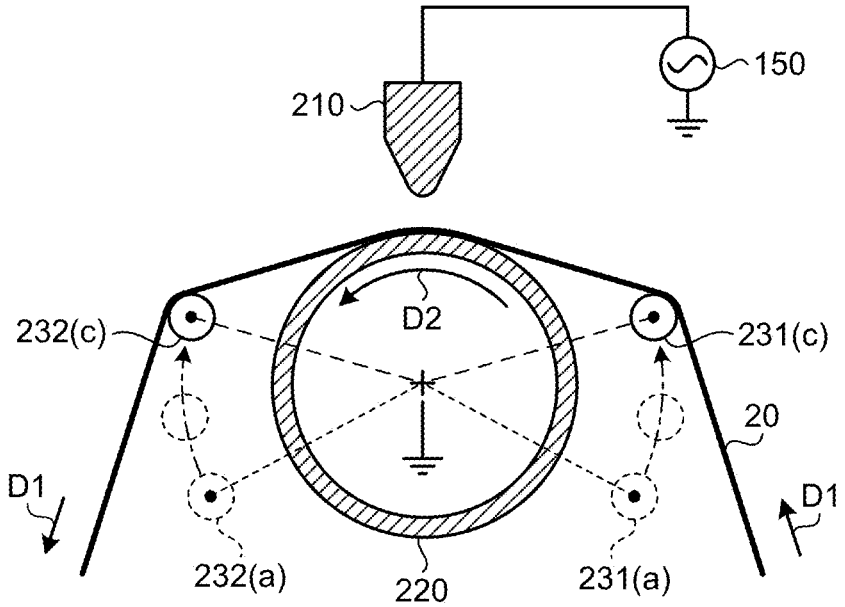
FIG. 13 is a view illustrating a positional relation between a treatment target and a dielectric roller when adjusting rollers are present at an uppermost point in the first modification.
Figure 14:
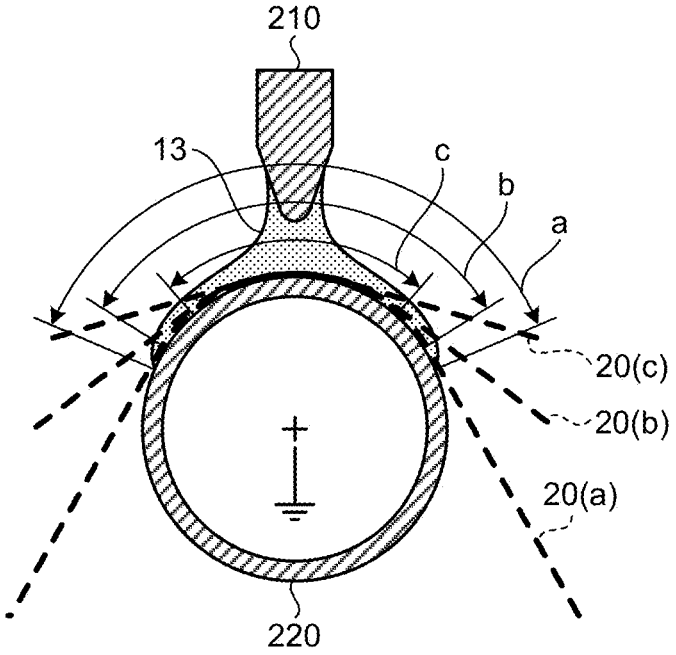
FIG. 14 is a view illustrating an example of a treatment width relative to the adjusting rollers in the first modification.
Figure 15:
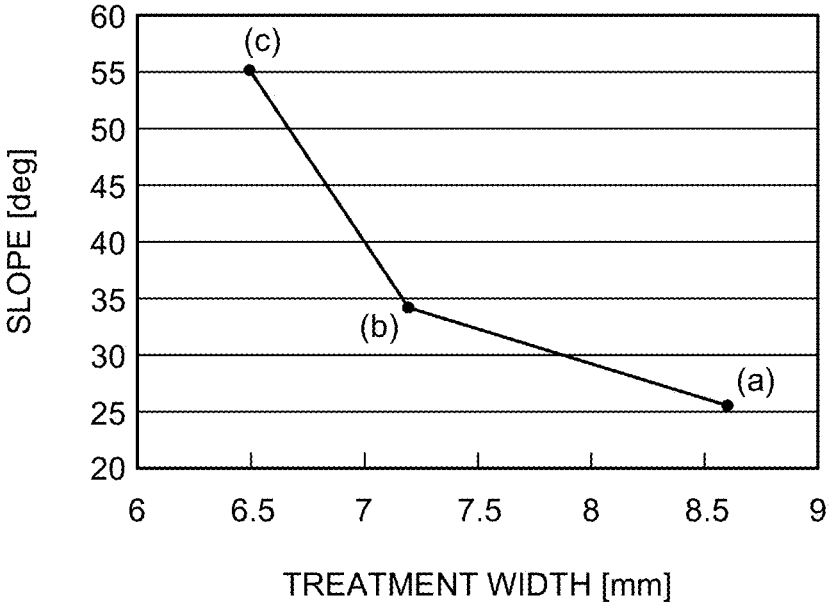
FIG. 15 is a graph illustrating an example of a relation between a slope and a treatment width of the treatment target in the first modification.

Next, a relation between positions of the adjusting rollers 231 and 232 and the treatment width for the plasma treatment will be described. FIGS. 11 to 13 are views illustrating a positional relation between the treatment target and the dielectric roller relative to positions of the adjusting rollers. FIG. 14 is a view illustrating an example of the treatment width relative to the positions of the adjusting rollers. FIG. 15 is a graph illustrating an example of a relation between a slope and the treatment width of the treatment target. The slope of the treatment target is an angle that is changed by the position of the adjusting roller. The slope may be a slope of a flat portion of the treatment target 20 relative to a direction of a shortest distance that connects the discharge electrode 210 and the counter electrode 221.

As illustrated in FIGS. 11 to 13, the adjusting rollers 231 and 232 are movable in respective directions D11 and D12. Here, the adjusting rollers 231 and 232 located at a lowermost point are assumed to be adjusting rollers 231(*a*) and 232(*a*), and the adjusting rollers 231 and 232 located at an uppermost point are assumed to be adjusting rollers 231(*c*) and 232(*c*). The adjusting rollers 231 and 232 located between the lowermost point and the uppermost position are assumed to be adjusting rollers 231(*b*) and 232(*b*). Moving mechanisms of the adjusting rollers 231 and 232 may use, for instance, a configuration disclosed in Japanese Patent Application Laid-open No. 11-138928, and thus a detailed description thereof will be omitted herein. Further, the directions D11 and D12 may be, for instance, directions that run along a circular arc whose center is set to the central line of the counter electrode 221, but are not limited thereto.

As illustrated in FIG. 11, when the adjusting rollers 231(*a*) and 232(*a*) are located at the lowermost point, the contact width between the treatment target 20 and the dielectric roller 220 is longest. Further, as illustrated in FIG. 12, as the adjusting rollers 231(*b*) and 232(*b*) move from the lowermost point to the uppermost point, the contact width is gradually reduced. Thus, as illustrated in FIG. 13, when the adjusting rollers 231(*c*) and 232(*c*) are located at the uppermost point, the contact width is shortest.

Here, a creeping discharge occurs at the side of the dielectric roller 220 between the discharge electrode 210 and the dielectric roller 220. For this reason, as illustrated in FIG. 14, the atmospheric non-equilibrium plasma 13 is mainly formed in a range widened along the outer periphery of the dielectric roller 220. Thereby, as illustrated in FIGS. 14 and 15, a width (treatment width) with which the treatment target 20 is in contact with the atmospheric non-equilibrium plasma 13 becomes a longest treatment width a when the adjusting rollers 231(*a*) and 232(*a*) are located at the lowermost point, a treatment width b that is gradually reduced as the adjusting rollers 231(*b*) and 232(*b*) move from the lowermost point to the uppermost point, and a shortest treatment width c when the adjusting rollers 231(*c*) and 232(*c*) are located at the uppermost point. FIG. 15 illustrates values when a diameter of the dielectric roller 220 is set to 50 mm.

In FIG. 14, a treatment target 20(*a*) indicates a position of the treatment target 20 when the adjusting rollers 231(*a*) and 232(*a*) are located at the lowermost point, and a treatment target 20(*b*) indicates a position of the treatment target 20 when the adjusting rollers 231(*b*) and 232(*b*) are located between the lowermost point and the uppermost point. A treatment target 20(*c*) indicates a position of the treatment target 20 when the adjusting rollers 231(*c*) and 232(*c*) are located at the uppermost point. Further, in FIG. 15, a point (a) indicates a slope and a treatment width of the treatment target 20 when the adjusting rollers 231(*a*) and 232(*a*) are located at the lowermost point, a point (b) indicates a slope and a treatment width of the treatment target 20 when the adjusting rollers 231(*b*) and 232(*b*) are located between the lowermost point and the uppermost point, and a point (c) indicates a slope and a treatment width of the treatment target 20 when the adjusting rollers 231(*c*) and 232(*c*) are located at the uppermost point.

The effect produced by the plasma treatment is dependent on the treatment width. That is, when a discharge occurs with the same plasma energy amount, the wider the treatment width, the greater the treatment effect. Accordingly, in the examples illustrated in FIGS. 11 to 15, the treatment effect is the maximum when the adjusting rollers 231(*a*) and 232(*a*) are located at the lowermost point (FIG. 11), whereas the treatment effect is the minimum when the adjusting rollers 231(*c*) and 232(*c*) are located at the uppermost point (FIG. 13).

Thus, by controlling the adjusting rollers 231 and 231 to adjust the treatment width according to a type of the treatment target 20, an image mode in which ink-jet recording is performed on the treatment target 20, or a type of the ink used, the plasma energy amount supplied to the treatment target 20 can be adjusted. Further, by controlling the adjusting rollers 231 and 231 to adjust the treatment width according to a variation in speed when the conveying speed of the treatment target 20 is changed, the plasma energy amount supplied to the treatment target 20 can also be constantly held.

Figure 16:
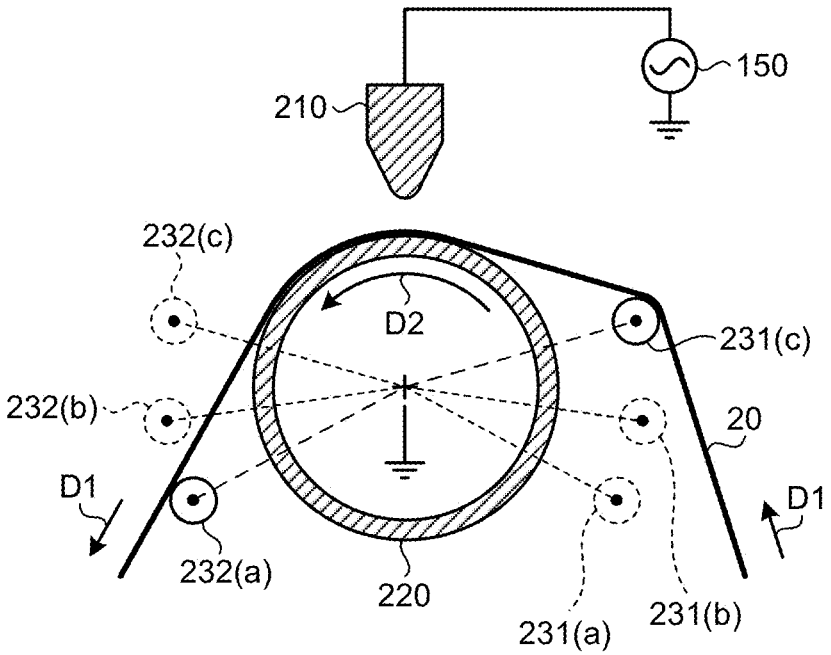
FIG. 16 is a view illustrating another example of driving the adjusting rollers in the first modification.
Figure 17:
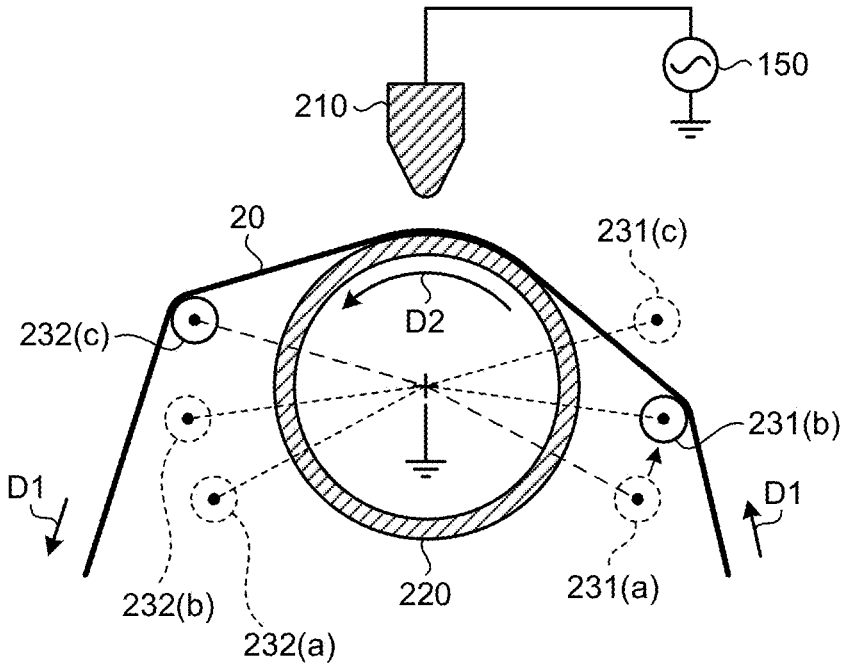
FIG. 17 is a view illustrating yet another example of driving the adjusting rollers in the first modification.

Further, the adjusting rollers 231 and 232 are not limited to a configuration in which both are caused to cooperate and move. For example, as illustrated in FIG. 16, only any one of the upstream adjusting roller 231 and the downstream adjusting roller 232 may be caused to move, or as illustrated in FIG. 17, the two adjusting rollers 231 and 232 may be caused to move at movement amounts different from each other. According to such a configuration, the treatment effect can be more precisely adjusted.

Second Specific Example

Figure 18:
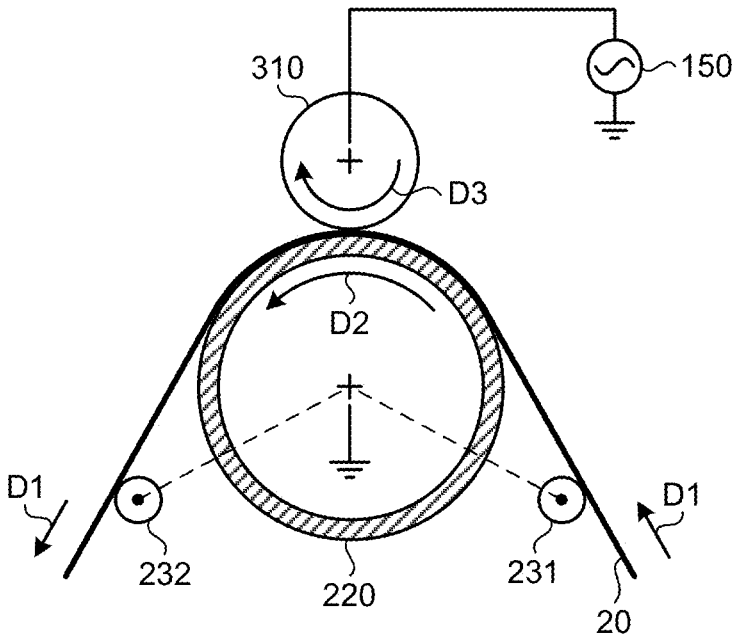
FIG. 18 is a schematic view illustrating an example of a schematic configuration of a discharge unit in a plasma treatment apparatus according to a second modification.

FIG. 18 is a schematic view illustrating an example of a schematic configuration of a discharge unit in a plasma treatment apparatus according to a second specific example. As illustrated in FIG. 18, the discharge unit of the plasma treatment apparatus according to the second specific example has a configuration in which, in the same configuration as the discharge unit of the plasma treatment apparatus according to the first specific example (see FIG. 10), the discharge electrode 210 (see FIG. 10) is replaced by a cylindrical discharge electrode 310. The discharge electrode 310 is rotatable in the direction D3 around an axis perpendicular to a direction in which a treatment target 20 is conveyed along a conveying path D1, or a rotating axis parallel to a rotating axis of a dielectric roller 220.

Figure 19:
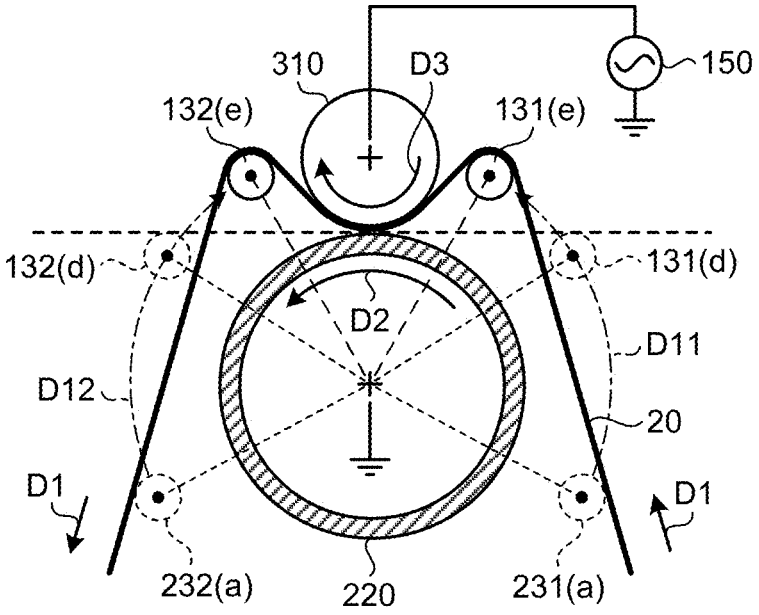
FIG. 19 is a view illustrating an example of driving the adjusting rollers in the second modification.

In this configuration, for example, as illustrated in FIG. 19, adjusting rollers 231 and 232 are caused to move along respective directions D11 and D12, so that, when they move to positions of adjusting rollers 231(*e*) and 232(*e*) which are beyond positions (positions of adjusting rollers 231(*d*) and 232(*d*)) at which the treatment target 20 and the dielectric roller 220 substantially come into line contact with each other, the treatment target 20 is wound on the side of the discharge electrode 310. In this case, since a space for active species generated by a discharge is formed between the dielectric roller 220 and the treatment target 20, plasma treatment for a rear face of the treatment target 20 is possible.

Figure 20:
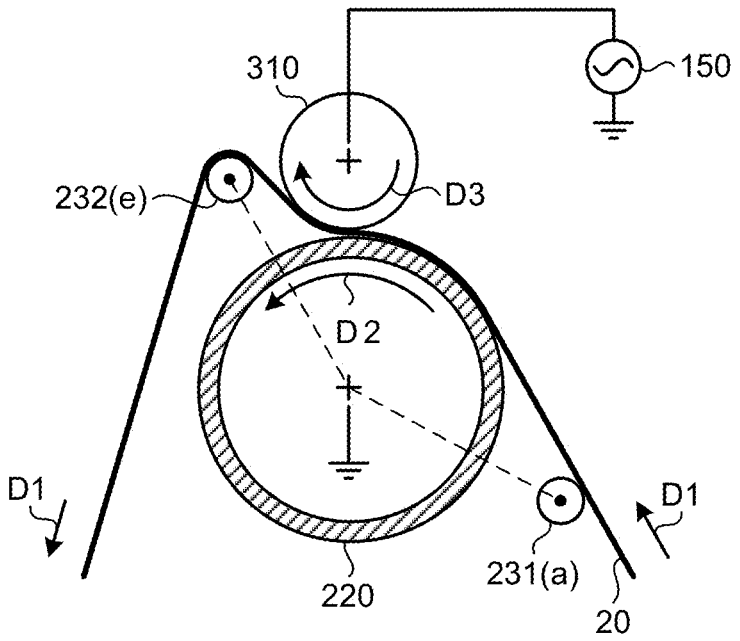
FIG. 20 is a view illustrating another example of driving the adjusting rollers in the second modification.
Figure 21:
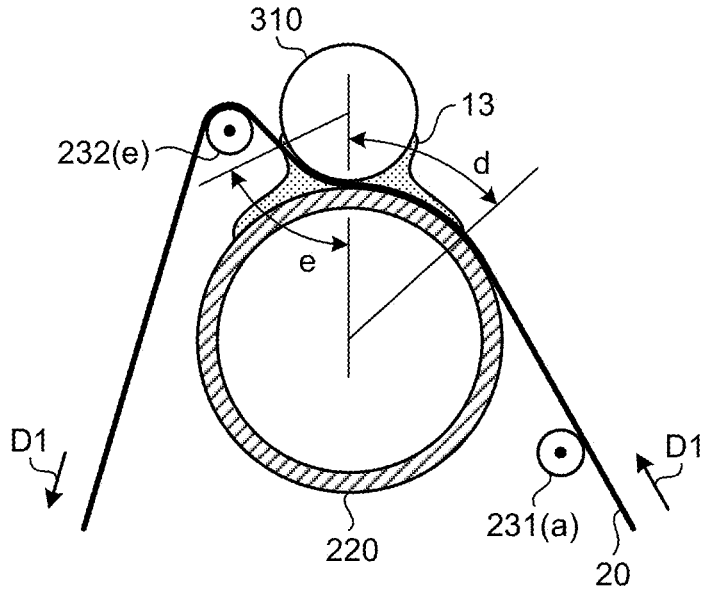
FIG. 21 is a view illustrating a treatment surface of a treatment target in the driving example illustrated in FIG. 20.

Further, as illustrated in FIG. 20, when only one (for instance, the adjusting roller 232) of the adjusting rollers 231 and 232 is caused to move to the position of the adjusting roller 232(*e*) beyond the position of the adjusting roller 232 (*d*) in the direction D12, only one side of the treatment target 20 is wound on the side of the discharge electrode 310. In this case, as illustrated in FIG. 21, a front face side of the treatment target 20 is subjected to the plasma treatment at the side (range d of FIG. 21) of the adjusting roller 231(*a*) which is not beyond the position at which the treatment target 20 and the dielectric roller 220 substantially come into line contact with each other, and the rear face side of the treatment target 20 is subjected to the plasma treatment at the side (range e of FIG. 21) of the adjusting roller 232(*e*) that moves beyond the position at which the treatment target 20 and the dielectric roller 220 substantially come into line contact with each other. In this way, only one of the adjusting rollers is caused to move beyond the position at which the treatment target 20 and the dielectric roller 220 substantially come into line contact with each other. Thereby, the plasma treatment for both of the front and rear faces of the treatment target 20 can be performed by once conveyance.

As another method of reducing the pH value of the surface of the treatment target 20 to a necessary pH value, it is considered to increase a time for the plasma treatment. This can be performed, for instance, by reducing the conveying speed of the treatment target 20. However, when image recording is performed on the treatment target 20 at a high speed, it is necessary to reduce the time for the plasma treatment. As a method of reducing the time for the plasma treatment, a method of providing multiple discharge electrodes and driving a necessary number of discharge electrodes according to a printing speed and a necessary pH value, or a method of adjusting an intensity of the plasma energy supplied to each discharge electrode is considered. However, without being limited thereto, a method of combining them or another method may be appropriately changed.

When the multiple discharge electrodes are provided, the aforementioned treatment width may be adjusted, for instance, in proportion to information about the printing speed, the number of driving discharge electrodes may be adjusted, a pulse intensity of a high-frequency high-voltage pulse supplied to each discharge electrode may be adjusted, and a combination of these adjustments may be fulfilled. The printing speed information may be information such as a printing mode (color printing and monochrome printing, or a resolution) for the ink-jet recording device 170, or information such as a rotating speed of a conveying roller or a throughput derived from such information. Further, the pulse intensity may be equivalent to the plasma energy amount, be a frequency or a voltage value (amplitude) of the high-frequency high-voltage pulse, and a control value calculated from these parameters.

However, strength of the plasma energy amount required for the plasma treatment may differ according to a type of medium. In such a case, according to the type of medium, the aforementioned treatment width may be adjusted, the number of driving discharge electrodes may be adjusted, the pulse intensity of the high-frequency high-voltage pulse supplied to each discharge electrode may be adjusted, and the combination of these adjustments may be fulfilled.

Further, behavior of a pigment contained in the ink differs according to the characteristics of the ink as described above. Thus, according to the type (characteristics) of the ink used, the aforementioned treatment width may be adjusted, the number of driving discharge electrodes may be adjusted, the pulse intensity of the high-frequency high-voltage pulse supplied to each discharge electrode may be adjusted, and the combination of these adjustments may be fulfilled.

Further, providing the multiple discharge electrodes is effective in that the surface of the treatment target 20 is uniformly acidified. That is, for example, in the case of the same conveying speed (or the same printing speed), when an acidifying process is performed by the multiple discharge electrodes rather than one discharge electrode, a time for which the treatment target 20 passes through a plasma space may be prolonged. As a result, the acidifying process can be more uniformly performed on the surface of the treatment target 20.

When the multiple discharge electrodes are provided, the high-frequency high-voltage power supplies individually provided for each discharge electrode may be independently turned on/off. In this case, in proportion to, for instance, the printing speed information, the number of driven high-frequency high-voltage power supplies can be selected, or the strength of the plasma energy amount of the pulse voltage given to each discharge electrode may be adjusted. Further, according to the type of the treatment target 20 (for instance, the coated paper or the PET film), the number of driven high-frequency high-voltage power supplies, and/or the plasma energy amount given to each discharge electrode may be adjusted.

The plasma energy amount required for the plasma treatment can be obtained from a treatment width at each discharge electrode, a voltage value and an applied time of the high-frequency high-voltage pulse supplied to each discharge electrode, and electric current flowing to the treatment target 20 at this time. The plasma energy required for plasma treatment may be controlled as an energy amount at all the discharge electrodes rather than each discharge electrode.

The treatment target 20 passes between the discharge electrode and a dielectric belt 121 during which the plasma is generated in the plasma treatment apparatus 100, and thereby the plasma treatment is performed. Thereby, a chain of a binder resin of the surface of the treatment target 20 is destroyed, and an oxygen radical or ozone in a gas phase is recombined with a polymer. Thereby, a polar functional group is created on the surface of the treatment target 20. As a result, the hydrophilicity and the acidification are provided for the surface of the treatment target 20. In this example, the plasma treatment is performed in the atmosphere, but may be performed in a gas atmosphere such as nitrogen or rare gas.

The present invention can provide a plasma treatment apparatus, a printing apparatus, a printing system, and a method of producing a printed matter that are capable of producing a high-quality printed matter while inhibiting an increase in cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A plasma treatment apparatus comprising:

a discharge electrode;

a dielectric, that is provided to come into contact with at least a surface of a treatment target, and has a curved surface with its convex surface directed toward the discharge electrode;

a counter electrode that is provided at a position facing the discharge electrode via the dielectric;

an adjusting roller configured to adjust a contact amount of the treatment target with respect to the dielectric; and a control unit configured to control the adjusting roller.

2. The plasma treatment apparatus according to claim 1, wherein the dielectric and the counter electrode constitute a rotatable dielectric roller.

3. The plasma treatment apparatus according to claim 2, wherein the adjusting roller includes a first adjusting roller located at an upstream side relative to the dielectric on a conveying path of the treatment target and a second adjusting roller located at a downstream side relative to the dielectric on the conveying path, the first adjusting roller adjusts a first contact amount between the treatment target, which is located at an upstream side relative to a line connecting the discharge electrode and the dielectric on the conveying path of the treatment target, and the dielectric, the second adjusting roller adjusts a second contact amount between the treatment target, which is located at a downstream side relative to the line connecting the discharge electrode and the dielectric on the conveying path, and the dielectric, and the control unit individually controls the first and second adjusting rollers.

4. The plasma treatment apparatus according to claim 1, wherein the discharge electrode is rotatable around a rotating axis parallel to a rotating axis of the counter electrode, and the adjusting roller biases the treatment target toward the discharge electrode such that the treatment target is wound around the discharge electrode.

5. The plasma treatment apparatus according to claim 2, wherein the adjusting roller includes a first adjusting roller located at an upstream side relative to the dielectric on a conveying path of the treatment target and a second adjusting roller located at a downstream side relative to the dielectric on the conveying path, the first adjusting roller adjusts a first contact amount between the treatment target, which is located at an upstream side relative to a line connecting the discharge electrode and the dielectric on the conveying path of the treatment target, and the dielectric, or biases the treatment target toward the discharge electrode such that the treatment target of the upstream side is wound around the discharge electrode, the second adjusting roller adjusts a second contact amount between the treatment target, which is located at a downstream side relative to the line connecting the discharge electrode and the dielectric on the conveying path, and the dielectric, or biases the treatment target toward the discharge electrode such that the treatment target of the downstream side is wound around the discharge electrode, and the control unit individually controls the first and second adjusting rollers.

6. A printing apparatus comprising:

a plasma treatment unit according to claim 1; and a recording unit configured to perform inkjet recording on the surface of the treatment target subjected to the plasma treatment by the plasma treatment unit.

7. A printing system comprising:

a plasma treatment apparatus configured to perform plasma treatment on at least a treatment target; and a recording device configured to perform ink jet recording on a surface of the treatment target subjected to the plasma treatment by the plasma treatment apparatus, wherein the plasma treatment apparatus includes:

a discharge electrode;

a dielectric that is provided to come into contact with at least a surface of the treatment target, and has a curved surface with its convex surface directed toward the discharge electrode;

a counter electrode that is provided at a position facing the discharge electrode via the dielectric; and an adjusting roller configured to adjust a contact amount of the treatment target with respect to the dielectric, and the printing system further includes a control unit configured to control the adjusting roller.

8. A method of producing a printed matter using a printing apparatus, the printing apparatus including a plasma treatment unit configured to perform plasma treatment on a surface of a treatment target to acidify at least the surface of the treatment target, and a recording unit configured to perform ink jet recording on the surface of the treatment target subjected to the plasma treatment of the plasma treatment unit, the plasma treatment unit including a discharge electrode, a dielectric that is provided to come into contact with at least a surface of the treatment target, and has a curved surface with its convex surface directed toward the discharge electrode, a counter electrode that is provided at a position facing the discharge electrode via the dielectric, and an adjusting roller configured to adjust a contact amount of the treatment target with respect to the dielectric, adjusting a contact amount of the treatment target with respect to the dielectric;

performing the plasma treatment on the treatment target using the plasma treatment unit; and performing the ink-jet recording on the treatment target surface using the recording unit.

* * * * *